US010941626B2

(12) United States Patent
Mageren

(10) Patent No.: US 10,941,626 B2
(45) Date of Patent: Mar. 9, 2021

(54) INNER BARREL SHEAR ZONE FOR A CORING TOOL

(71) Applicant: Halliburton Energy Services, Inc., Houston, TX (US)

(72) Inventor: Olivier Mageren, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 200 days.

(21) Appl. No.: 16/075,324

(22) PCT Filed: Mar. 3, 2016

(86) PCT No.: PCT/US2016/020616

§ 371 (c)(1),
(2) Date: Aug. 3, 2018

(87) PCT Pub. No.: WO2017/151131

PCT Pub. Date: Sep. 8, 2017

(65) Prior Publication Data

US 2019/0264521 A1 Aug. 29, 2019

(51) Int. Cl.

| | |
|---|---|
| ***E21B 25/10*** | (2006.01) |
| ***E21B 25/02*** | (2006.01) |
| ***E21B 25/00*** | (2006.01) |
| ***E21B 17/06*** | (2006.01) |
| ***E21B 17/00*** | (2006.01) |

(Continued)

(52) U.S. Cl.

CPC ..... *E21B 25/10* (2013.01); *E21B 10/02* (2013.01); *E21B 17/00* (2013.01); *E21B 17/06* (2013.01); *E21B 25/00* (2013.01); *E21B 25/005* (2013.01); *E21B 25/02* (2013.01); *E21B 29/002* (2013.01)

(58) Field of Classification Search

CPC ..... E21B 25/10; E21B 25/00; E21B 25/02; E21B 25/005; E21B 10/02; E21B 17/00; E21B 17/06; E21B 29/002; E01F 9/635

See application file for complete search history.

(56) References Cited

U.S. PATENT DOCUMENTS 1,984,867 A * 12/1934 Dean ..... E21B 25/00 175/251
2,499,543 A 3/1950 Townsend (Continued)

FOREIGN PATENT DOCUMENTS

CN 201371477 12/2009
EP 0248615 A2 * 12/1987 ..... E21B 25/00

(Continued)

OTHER PUBLICATIONS

International Search Report and Written Opinion for PCT Patent Application No. PCT/US2016/020616, dated Nov. 29, 2016; 17 pages.

(Continued)

*Primary Examiner* — George S Gray
(74) *Attorney, Agent, or Firm* — Thomas Rooney; Baker Botts L.L.P.

(57) ABSTRACT

The inner barrel system includes a coring inner barrel. The system also includes a connector sub coupled to the coring inner barrel. The connector sub includes a tubular wall defining a central axis and a shear zone extending longitudinally along at least a portion of the tubular wall. The shear zone severs with less force than the coring inner barrel.

20 Claims, 4 Drawing Sheets

(51) Int. Cl.
*E21B 10/02* (2006.01)
*E21B 29/00* (2006.01)

(56) References Cited

U.S. PATENT DOCUMENTS

| | | | | |
|---|---|---|---|---|
| 3,363,703 | A | 1/1968 | Shewmake | |
| 4,499,924 | A | 2/1985 | Garrett | |
| 4,569,710 | A * | 2/1986 | Lambot | E21B 25/005 156/172 |
| 5,163,522 | A | 11/1992 | Eaton et al. | |
| 5,746,253 | A | 5/1998 | Dust et al. | |
| 8,579,049 | B2 | 11/2013 | Kinsella | |
| 8,783,361 | B2 | 7/2014 | Zediker et al. | |
| 2012/0037427 | A1 | 2/2012 | Kinsella | |
| 2012/0234607 | A1 | 9/2012 | Kinsella | |
| 2013/0220615 | A1* | 8/2013 | Drenth | E21B 10/325 166/298 |
| 2014/0311741 | A1 | 10/2014 | Tunget | |
| 2015/0275604 | A1 | 10/2015 | Koen Vos | |
| 2015/0337654 | A1 | 11/2015 | Alshannaq et al. | |

FOREIGN PATENT DOCUMENTS

| | | | |
|---|---|---|---|
| EP | 0248615 | A2 | 12/1987 |
| WO | 2012/069713 | A1 | 5/2012 |
| WO | 2014-018737 | | 1/2014 |

OTHER PUBLICATIONS

238-P Powered Soil Pipe Cutter, https://www.ridgid.com/us/en/238p-powered-soil-pipe-cutter, Emerson Electric Co., web accessed 2018, 5 pages, Web Accessed Jul. 20, 2018.

Screen captures from YouTube video clip entitled, "Ridgid Powered Soil Pipe Cutter," 3 pages, uploaded on Feb. 4, 2013 by "Ridgid Tools", Retrieved from the Internet: https://www.youtube.com/watch?v=IYHZPlhmqkg.

"Wireline Coring," ALS Oil & Gas, http://www.corpro-group.com/service-offering/downhole-equipment/wireline-coring/, 2013, Web Accessed Apr. 16, 2015.

* cited by examiner

INNER BARREL SHEAR ZONE FOR A CORING TOOL

RELATED APPLICATIONS

This application is a U.S. National Stage Application of International Application No. PCT/US2016/020616 filed Mar. 3, 2016, which designates the United States, and which is incorporated herein by reference in its entirety.

TECHNICAL FIELD

The present disclosure relates generally to downhole coring operations and, more particularly, to an inner barrel shear zone for a coring tool.

BACKGROUND

Conventional coring tools used to obtain core samples from a borehole include a tubular housing attached at one end to a special bit often referred to as a core bit, and at the other end to a drill string extending through the borehole to the surface. The tubular housing is usually referred to as an outer barrel or core barrel. The outer barrel contains an inner barrel or inner tube with a space between the outer surface of the inner barrel and the inner surface of the outer barrel. During a coring operation, the core bit drills into a formation and extracts a core sample of that formation. The core sample enters and fills the inner barrel, which is then subsequently retrieved to the surface.

BRIEF DESCRIPTION OF THE DRAWINGS

For a more complete understanding of the present disclosure, its features and advantages, reference is now made to the following description, taken in conjunction with the accompanying drawings, in which.

DETAILED DESCRIPTION

The present disclosure relates to coring tools and methods of separating inner barrels after capturing a core sample within the inner barrels. A connector sub or a coring inner barrel may be provided with a shear zone that facilitates severing the inner barrel or core sample, such as by shearing or breaking. A coring tool may have multiple connected inner barrels that may house and protect an extracted core sample as the core sample is retrieved to the surface. The inner barrels may be connected to one another by abutting the ends, wherein one or more inner barrels include a shear zone. Alternatively, a connector sub coupled to one or more inner barrels may include the shear zone. The shear zone may be configured in a variety of ways such that it is easier to sever than adjacent portions of the inner barrel or connector sub. For example, the shear zone may be less ductile and/or more brittle than adjacent portions of the inner barrel or connector sub. The shear zone may be characterized in terms of factors that affect the relative ease by which the inner barrel or connector sub severs at the shear zone, such as the brittleness and/or ductility of the shear zone. For example, the shear zone may be constructed of a relatively weak or brittle material in comparison with the material used to construct adjacent portions of the inner barrel or connector sub. For example, the shear zone may be formed of cast iron or aluminum smelting. As another example, in the case where the shear zone is located on an inner barrel, the shear zone may be the same material as the inner barrel, but may be heat treated locally, such as with a laser, to create a portion that is easier to shear (e.g., is more brittle or has lower ductility) than the remainder of the inner barrel or connector sub. The shear zone allows for easier separation of the inner barrels and the core samples, which may be separated into smaller sections after removal from a wellbore. For example, the shear zone of the inner barrel or the connector sub may be severed using a fast pipe cutter, and may reduce associated time, labor, and expense involved in separating the inner barrels. Further, including a shear zone on the inner barrel or the connector sub may minimize damage or impact on the core sample experienced during separation of the inner barrels. As compared to prior coring tools and methods, those of the present disclosure may be more versatile or easier-to-use and may also provide higher quality core samples, which allow for higher quality measurements of the core samples.

Embodiments of the present disclosure and their advantages may be better understood by referring to FIGS. 1-5, where like numbers are used to indicate like and corresponding parts.

Figure 1:
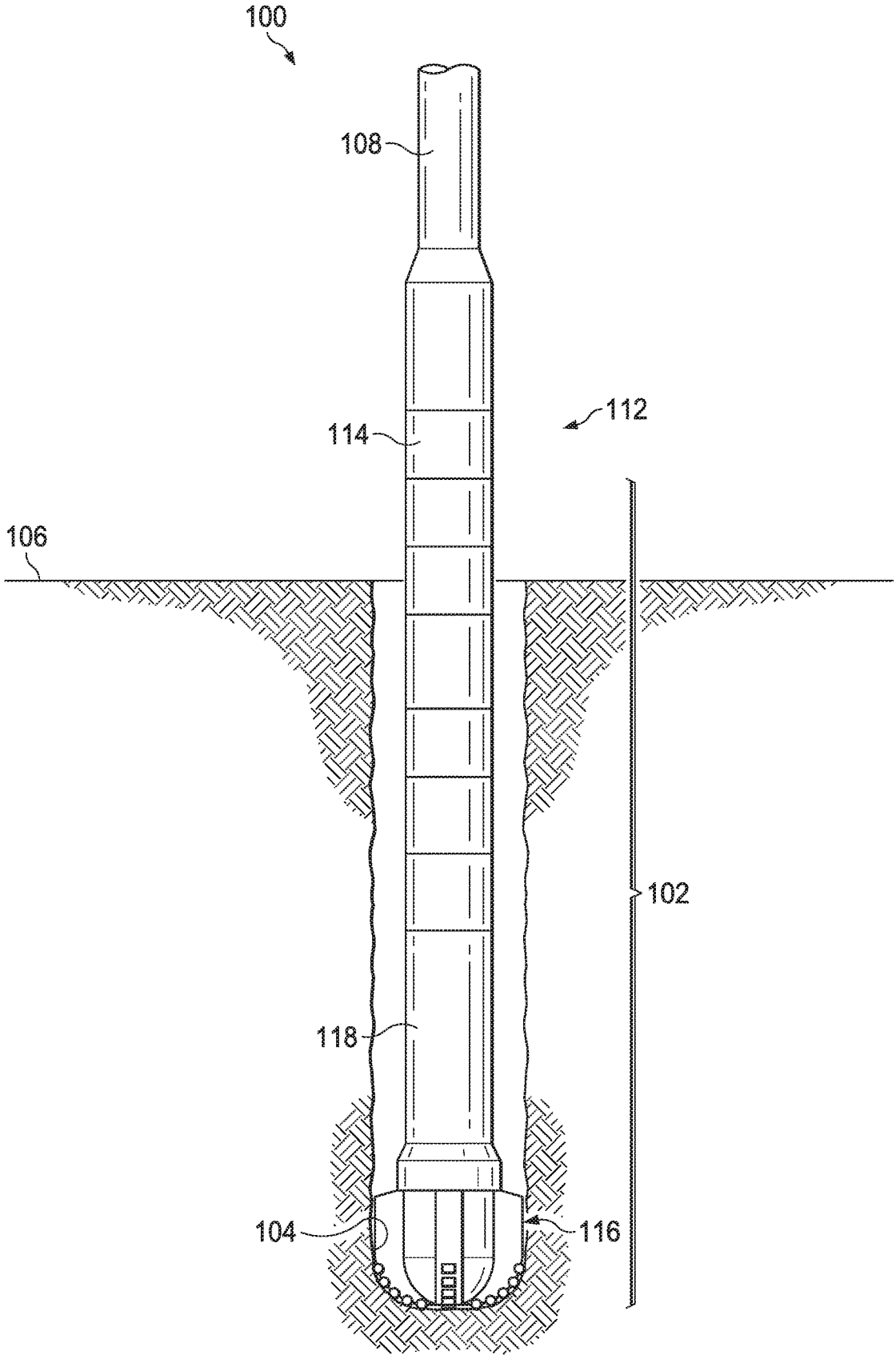
FIG. 1 is an elevation view, with portions broken away, of a drilling system at a well site.

FIG. 1 is an elevation view, with portions broken away, of a drilling system 100 at a well site 106. A drilling rig (not expressly shown) may be included at the well site 106 to support and operate a drill string 108 at the well site 106 for drilling a wellbore 104. Such a drilling rig may be used to suspend the drill string 108 over the wellbore 104 as the wellbore 104 is drilled, and may include various types of drilling equipment such as a rotary table, drilling fluid pumps, and drilling fluid tanks used in drilling. Such a drilling rig may have various characteristics and features associated with a "land drilling rig," such as a rig floor. However, the present teachings are not limited to use with a land drilling rig and may be equally used with offshore platforms, drill ships, semi-submersibles, and drilling barges.

The drill string 108 further includes a bottom hole assembly (BHA) 112. The BHA 112 may be assembled from a plurality of various components that operationally assist in forming the wellbore 104 including extracting core samples from the wellbore 104. For example, the BHA 112 may include drill collars, rotary steering tools, directional drilling tools, downhole drilling motors, drilling parameter sensors for weight, torque, bend and bend direction measurements of the drill string and other vibration and rotational related sensors, hole enlargers such as reamers, stabilizers, measurement while drilling (MWD) components containing wellbore survey equipment, logging while drilling (LWD) sensors for measuring formation parameters, short-hop and long haul telemetry systems used for communication, and/or any other suitable downhole equipment. The number and different types of components included in the BHA 112 may depend upon anticipated downhole drilling conditions and the type of wellbore that will be formed.

The BHA 112 may include a swivel assembly 114. The swivel assembly 114 may be an integrated component of a coring tool 102 used to isolate rotation of and torque used in rotation of a core bit 116 from other components of the coring tool 102, such as the inner barrel (as shown in FIG. 2).

The coring tool 102 (as shown in more detail in FIG. 2) is coupled to the drill string 108. The coring tool 102 and the drill string 108 extend downhole from the well site 106. The coring tool 102 includes the core bit 116, which may have a central opening and may include one or more blades disposed outwardly from exterior portions of a bit body of the core bit 116. The bit body may be generally curved and the one or more blades may be any suitable type of projections extending outwardly from the bit body. The blades may include one or more cutting elements disposed outwardly from exterior portions of each blade. The core bit 116 may be any of various types of fixed cutter core bits, including polycrystalline diamond cutter (PDC) core bits, including thermally stable polycrystalline diamond cutter (TSP) core bits, matrix core bits, steel body core bits, hybrid core bits, and impreg core bits operable to extract a core sample from the wellbore 104. The core bit 116 may have many different designs, configurations, or dimensions according to the particular application of the core bit 116. The coring tool 102 further includes an outer barrel 118 and an inner barrel (discussed in detail with reference to FIG. 2) located inside the outer barrel 118.

Figure 2:
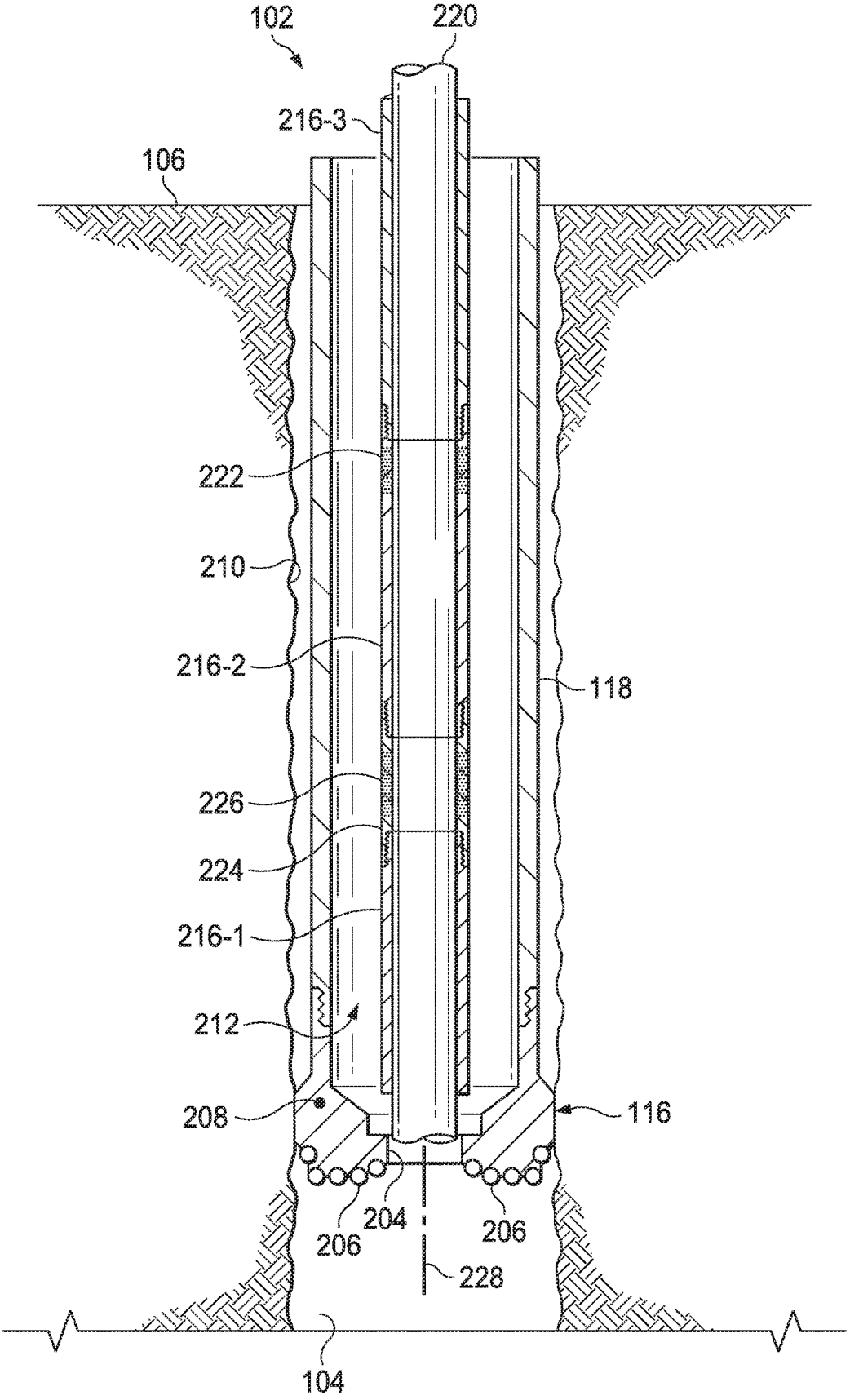
FIG. 2 is a cross-sectional view of the coring tool of FIG. 1 used to extract and store, after extraction, a core sample from a wellbore.

FIG. 2 is a cross-sectional view of the coring tool 102, as shown in FIG. 1, used to extract and store, after extraction, a core sample 220 from the wellbore 104. The coring tool 102 includes the core bit 116 having a generally cylindrical body and including a throat 204 that extends longitudinally through the core bit 116. The throat 204 of the core bit 116 may receive the core sample 220. The core bit 116 includes one or more cutting elements 206 disposed outwardly from exterior portions of a core bit body 208. A portion of each cutting element 206 may be directly or indirectly coupled to an exterior portion of the core bit body 208. Cutting elements 206 may be any suitable device configured to cut into a formation, including but not limited to, primary cutting elements, back-up cutting elements, secondary cutting elements or any combination thereof. By way of example and not limitation, cutting elements 206 may be various types of cutting elements, compacts, buttons, inserts, and gage cutting elements satisfactory for use with a wide variety of core bits 116.

In operation, the core bit 116 extracts the core sample 220 from a formation such that the core sample 220 has a diameter that is approximately equal to or less than the diameter of the throat 204. The core bit 116 may be coupled to or integrated with the outer barrel 118. The outer barrel 118 is separated from one or more inner barrels 216 by an annulus 212 that may have a generally cylindrical geometry. The outer barrel 118 may include barrel stabilizers (not expressly shown) to stabilize and provide consistent standoff of the outer barrel 118 from a sidewall 210. Further, the outer barrel 118 may include additional components, such as sensors, receivers, transmitters, transceivers, sensors, calipers, and/or other electronic components that may be used in a downhole measurement system or other particular implementation. The outer barrel 118 may be coupled to and remain in contact with a well site 106 during operation.

The inner barrels 216-1, 216-2 and 216-3 (collectively "inner barrels 216") pass through the outer barrel 118. The inner barrels 216 may form a tubular wall and have a generally cylindrical geometry. The tubular wall of the inner barrels 216 defines a central axis 228 extending approximately through the center of the inner barrels 216. The inner barrels 216 may be housed in the outer barrel 118 and may be configured to slideably move uphole and downhole partially within the outer barrel 118. In some configurations, the inner barrels 216 may extend beyond the outer barrel 118.

The inner barrels 216 may house the core sample 220 extracted from the formation surrounding the wellbore 104. Following extraction from the wellbore 104, the core sample 220 is stored in the inner barrels 216 and later returned to the surface by retrieving the inner barrels 216 by wireline or by extraction of the coring assembly from the wellbore 104. Once the core sample 220 is returned to the surface, it may be severed, such as by cutting, shearing, or breaking, into multiple segments for box storage, transportation and further processing. For example, the core sample may be severed to separate the core sample in the inner barrel 216-1, the core sample in the inner barrel 216-2, and the core sample in the inner barrel 216-3. As discussed in further detail below, use of the inner barrels 216 of the present disclosure may minimize damage to the core sample 220 during severing and transport.

A connector sub 224 may operate to couple or connect the inner barrels 216. For example, the connector sub 224 couples the inner barrel 216-1 with the inner barrel 216-2. The connector sub 224 may form a tubular wall and may be constructed of the same or similar material as the inner barrels 216. The tubular wall of the connector sub 224 may also define the central axis 228 extending approximately through the center of the inner barrels 216 and the connector sub 224. Further, the inner barrels 216 and/or the connector sub 224 may be coupled by an outer sub, a ring, or any other suitable coupling apparatus.

One or more of the inner barrels 216 may include an inner barrel shear zone 222 formed on one end of the inner barrel 216 along a longitudinal length of the inner barrel 216. For example, the inner barrel 216-2 includes the inner barrel shear zone 222. In some examples, the inner barrels 216 may be coupled by the connector sub 224, which includes a connector sub shear zone 226. For example, the inner barrel 216-2 and the inner barrel 216-1 are coupled to the connector sub 224 that includes the connector sub shear zone 226.

The inner barrels 216 may be constructed of any material suitable for containing a core sample, such as, aluminum, steel, fiberglass or any other suitable material. The inner barrel shear zone 222 and the connector sub shear zone 226 may be constructed of a material that maintains yield strength and tensile strength approximately equivalent to the yield strength and tensile strength of the inner barrels 216. The inner barrel shear zone 222 and the connector sub shear zone 226 may be constructed of a material that is more brittle, easier to shear, or has a lower ductility than the adjacent portions of the inner barrels 216 such that the shear zone 226 can be severed with less force than the adjacent portions of the inner barrels 216. For example, the inner barrel shear zone 222 and the connector sub shear zone 226 may be constructed of cast iron, aluminum smelting, or other material with similar properties. Additionally, by way of example and not limitation, the inner barrel shear zone 222 and the connector sub shear zone 226 may have a ductility according to the following elongation ratio:

$$\left(\frac{\varepsilon_{inner\ barrel}}{\varepsilon_{shear}} = \right)\varepsilon_{ratio} \geq 1 \tag{1}$$

where:

$\varepsilon_{inner\ barrel}$=elongation measurement of the inner barrel;

$\varepsilon_{shear}$=elongation measurement of the inner barrel shear zone or the connector sub shear zone; and $\varepsilon_{ratio}$=elongation ratio.

Also as an example only, the inner barrel shear zone 222 and the connector sub shear zone 226 may have a ductility having a fracture strain of approximately less than 5%.

As another example, the inner barrel shear zone 222 and the connector sub shear zone 226 may be constructed of the same material as the inner barrels 216 but may include a portion that has been heat treated locally, such as with a laser, a torch, or other appropriate tempering method, to create a portion that is weaker, is more brittle, or has a lower ductility such that the inner barrel shear zone 222 can be severed with less force than adjacent portions of the inner barrels 216. The inner barrel shear zone 222 and the connector sub shear zone 226 allow for easier severing of the inner barrels 216 or the connector sub 224 and separation of the core sample 220 into sections after removal from the wellbore 104. Use of the connector sub shear zone 226 may allow for the inner barrels 216 to be re-used in a subsequent coring operation because the inner barrels 216 may not be damaged during severing operations. Additionally, the inner barrel shear zone 222 and the connector sub shear zone 226 may be scored to allow for easier severing after removal from the wellbore.

Figure 3:
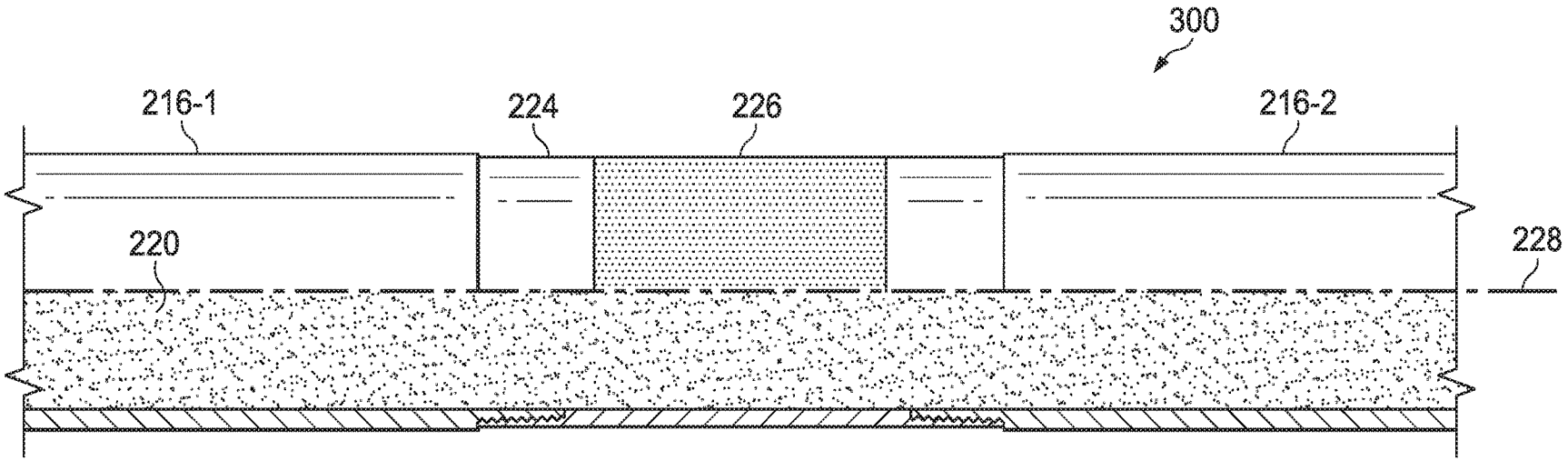
FIG. 3 is an exemplary inner barrel connection including a connector sub.

FIG. 3 is an exemplary inner barrel system 300 including a connector sub 224. The system 300 includes inner barrels 216-1 and 216-2 coupled by a connector sub 224. The system 300 may further include an outer sub (not expressly shown), a ring (not expressly shown), or other suitable coupling apparatus. The core sample 220 may be extracted and housed in the inner barrels 216. The connector sub 224 may couple the inner barrels 216-1 and 216-2 by any suitable apparatus, such as threaded connections, press fit connections, welding, or other appropriate devices or methods. The connector sub 224 may be constructed of metal or any other suitable material based on the specific implementation. The connector sub 224 may include additional components (not expressly shown), such as an upper sub, a union nut, a stabilizer, a lower sub, or other suitable components. The connector sub 224 may further include a connector sub shear zone 226 extending longitudinally in the direction of the central axis 228 for at least a portion of the connector sub 224. The connector sub shear zone 226 may be of any suitable longitudinal length and may be configured to enable severing of the connector sub 224 using a fast pipe cutter or other cutting tool.

The connector sub 224 may be used to couple multiple sections of the inner barrels 216 together. For example, at a well site 106 as shown in FIG. 1, the connector sub 224 may be used to couple a series of inner barrels 216 together. During coring operations, the core sample 220 may be captured and housed in the inner barrels 216, which may be returned to the surface. After the inner barrels 216 return to the surface with an extracted core sample 220, the connector sub shear zones 226 allow for efficient severing and separation of each inner barrel 216 from adjacent inner barrels 216. The core sample 220 may be severed to separate the core sample 220 in the different inner barrels 216. In some examples, after the coring operation, the connector sub shear zones 226 may be severed using any suitable pipe cutting tool, such as a manual tool that may include a chain that creates multiple indentations in the connector sub shear zones 226, using a fast pipe cutter, or using any other suitable cutting tool.

Figure 4:
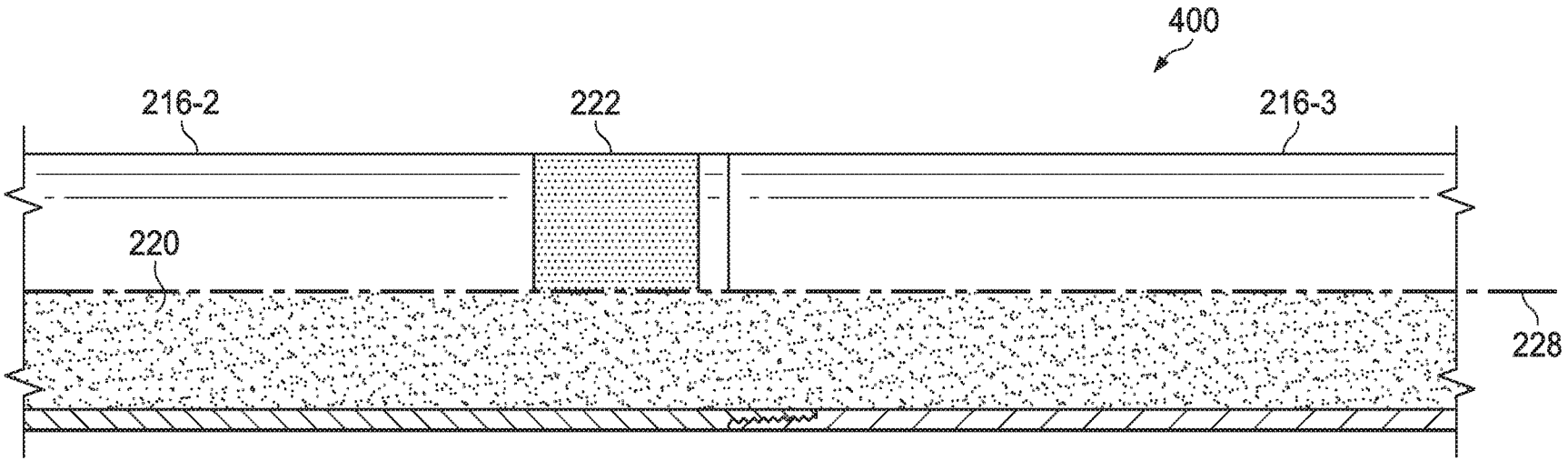
FIG. 4 is an exemplary inner barrel connection including an inner barrel shear zone.

FIG. 4 is an exemplary inner barrel system 400 including an inner barrel shear zone 222. The system 400 includes inner barrels 216-2 and 216-3. The inner barrels 216-2 and 216-3 may be abutted to each other and coupled using any suitable mechanism, such as threaded connections, press fit connections, or other appropriate devices. The inner barrel 216-2 may further include an inner barrel shear zone 222 extending longitudinally in the direction of a central axis 228 proximate to one end of the inner barrel 216-2. The inner barrel shear zone 222 may be of any suitable longitudinal length and configured to enable severing of the inner barrel 216-2 using a fast pipe cutter or other cutting tool. Further, the inner barrel shear zone 222 may be configured to be thinner or have a smaller outer diameter than adjacent portions of the inner barrel 216, may be locally heat treated, and/or may be constructed of a different material than adjacent portions of the inner barrel 216.

The inner barrels 216 may be configured to connect or couple to other inner barrels 216 prior to deployment of the inner barrels downhole. For example, at a well site 106 as shown in FIG. 1, a series of inner barrels 216 may be coupled together. During coring operations, the core sample may be housed in inner barrels 216, which may be returned to the surface. As the inner barrels 216 return to the surface with an extracted core sample 220, the inner barrel shear zones 222 allow for efficient severing and separation of each inner barrel 216 from adjacent inner barrels 216. The core sample 220 may be severed to separate the core sample 220 in the different inner barrels 216. Severing and separating the inner barrels 216 that include inner barrel shear zones 222 may be accomplished using any suitable pipe cutting tool, such as a manual tool that may include a chain that creates multiple indentations in inner barrel shear zones 222, a fast pipe cutter, or using any other suitable cutting tool.

Figure 5:
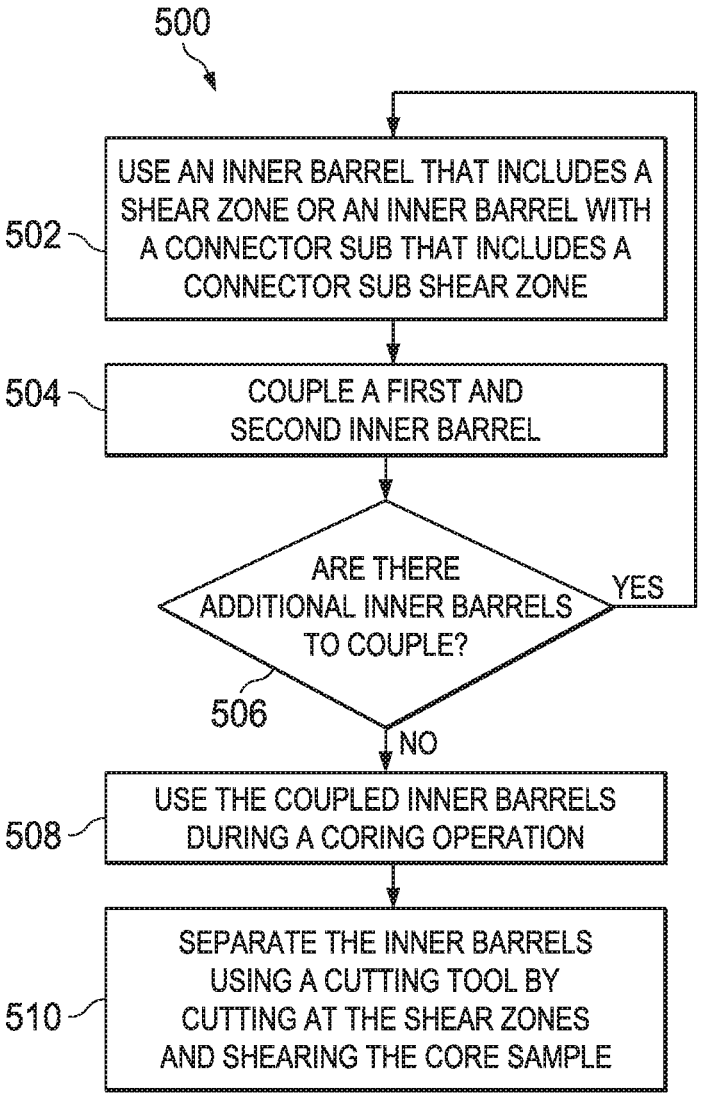
FIG. 5 is a flow chart of a method of using shear zones to separate inner barrels.

FIG. 5 is a flow chart of a method of using shear zones to separate the inner barrels. A method 500 begins at step 502, where an operator uses an inner barrel that includes a shear zone proximate to one end or uses an inner barrel with a connector sub that includes a connector sub shear zone. For example, with reference to FIG. 2, the connector sub shear zone 226 may be created on at least a portion of the connector sub 224. The connector sub shear zone 226 may be more brittle, easier to shear, or have a lower ductility than the inner barrels 216 such that the connector sub shear zone 226 can be severed with less force than the adjacent portions of the inner barrels 216. The connector sub shear zone 226 be a different material from the inner barrel 216, such as cast iron, aluminum smelting, or other suitable material. The connector sub shear zone 226 may be a heat treated or laser treated portion of the connector sub 224. The connector sub shear zone 226 may be a material that is more brittle, easier to sever, or has a lower ductility than the inner barrels 216 or other portions of the connector sub 224 such that the connector sub shear zone 226 can be severed with less force than the connector sub 224. As another example, with reference to FIG. 2, the inner barrel shear zone 222 may be generated on at least a portion of an inner barrel 216. The inner barrel shear zone 222 may be more brittle, easier to sever, or have a lower ductility than surrounding portions of an inner barrel 216 such that the inner barrel shear zone 222 can be severed with less force than the adjacent portions of the inner barrel 216. The inner barrel shear zone 222 may be a heat treated or laser treated portion of the inner barrel 216. The connector sub shear zone 226 or the inner barrel shear zone 222 may have a ductility that satisfies the elongation ratio shown in Equation (1), or as another example, may have a ductility represented by a fracture strain of approximately less than 5%.

At step 504, the operator couples a first and second inner barrel together. For example, with reference to FIG. 2, the inner barrels 216 are coupled to each other, in some cases using the connector sub 224. The operator may insert one end of an inner barrel into a coupling apparatus, such as an outer sub. The operator may then insert a connector sub. The operator may then position the second inner barrel in the coupling apparatus.

At step 506, the operator determines whether there are additional inner barrels to couple together. If there are additional inner barrels to couple, the method 500 may return to step 502 to couple the next inner barrel. If there are no additional inner barrels to couple, the method 500 may proceed to step 508.

At step 508, the operator uses the coupled inner barrels during a coring operation. During the coring operation, the operator lowers the inner barrel assembly into an outer barrel located downhole in a wellbore, uses the inner barrel assembly to capture and house a core sample, and returns the inner barrel assembly to the surface to obtain the core sample. For example, with reference to FIG. 2, the inner barrels 216 are lowered into the outer barrel 118 and house the core sample 220. Once the core sample 220 is housed in the inner barrels 216, the inner barrels 216 are returned to the surface in order to obtain the core sample.

At step 510, the operator separates the inner barrels using a cutting tool by severing at the shear zones and severing the core sample. For example, with reference to FIG. 3, a cutting tool, such as a fast pipe cutter, may be used to sever the connector sub 224 at the connector sub shear zone 226. As another example, with reference to FIG. 4, a cutting tool, such as a fast pipe cutter, may be used to sever the inner barrel 216-2 at the inner barrel shear zone 222. By using shear zones, such as the connector sub shear zone 226 or the inner barrel shear zone 222 with increased brittleness or lower ductility, severing, and separating the inner barrels is simpler and easier than severing the inner barrels with no shear zones that may be less brittle or have a higher ductility. Further, because of the ease of separation, the potential for disturbing or damaging the core sample in the inner barrels is reduced. The rig time and associated expense necessary for severing the inner barrels is also mitigated. Additionally, in some cases, the inner barrels may be retrievable and reused. The core sample may remain protected along its length during processing and transportation. For example, the core sample 220 may be separated into lengths that are laid down for further processing or are transported to other processing locations.

Modifications, additions, or omissions may be made to the method 500 without departing from the scope of the present disclosure. For example, the order of the steps may be performed in a different manner than that described and some steps may be performed at the same time. Additionally, each individual step may include additional steps without departing from the scope of the present disclosure.

Embodiments disclosed herein include:

A. An inner barrel system that includes a coring inner barrel. The system also includes a connector sub coupled to the coring inner barrel. The connector sub includes a tubular wall defining a central axis and a shear zone that extends longitudinally along the central axis for at least a portion of the tubular wall. The shear zone severs with less force than the coring inner barrel.

B. An inner barrel system that includes a coring inner barrel including a tubular wall defining a central axis. The coring inner barrel has a shear zone extending longitudinally along at least a portion of the tubular wall. The shear zone severs with less force than the adjacent portions of the tubular wall.

C. A method includes coupling a connector sub with a coring inner barrel. The connector sub includes a tubular wall defining a central axis and a shear zone extending longitudinally along at least a portion of the tubular wall. The shear zone severs with less force than the coring inner barrel. The method includes using the coring inner barrel in a coring operation, and using a cutting tool to sever the connector sub at the shear zone.

D. A method including coupling a first coring inner barrel to a second coring inner barrel. The first coring inner barrel including a tubular wall defining a central axis and having a shear zone extends longitudinally along the central axis for at least a portion of the tubular wall, and the shear zone severs with less force than adjacent portions of the tubular wall. The method also includes using the first coring inner barrel and the second coring inner barrel in a coring operation, and using a cutting tool to cut the first coring inner barrel at the shear zone.

Each of embodiments A-D have one or more of the following additional elements in any combination: Element 1: wherein the shear zone has a lower ductility than the coring inner barrel. Element 2: wherein the shear zone has a lower ductility than the adjacent portions of the tubular wall. Element 3: wherein the ductility of the shear zone has a fracture strain less than 5%. Element 4: wherein the shear zone is constructed of a different material than the coring inner barrel. Element 5: wherein the shear zone extends a longitudinal length along the connector sub so that the shear zone can be cut with a fast pipe cutter. Element 6: using a cutting tool to cut the first coring inner barrel at the shear zone further comprises shearing a core sample. Element 7: wherein the ductility of the shear zone is determined according to an elongation ratio given by the formula:

$$\left(\frac{\varepsilon_{inner\ barrel}}{\varepsilon_{shear}}\right) = \varepsilon_{ratio}$$

where:

$\varepsilon_{inner\ barrel}$=elongation measurement of the coring inner barrel;

$\varepsilon_{shear}$=elongation measurement of the shear zone;

$\varepsilon_{ratio}$=the elongation ratio; and where the elongation ratio is greater than or equal to one.

Although the present disclosure and its advantages have been described in detail, it should be understood that various changes, substitutions and alternations can be made herein without departing from the spirit and scope of the disclosure as defined by the following claims.

What is claimed is:

1. An inner barrel system comprising:

a coring inner barrel; and a connector sub coupled to the coring inner barrel, the connector sub including:

a tubular wall defining a central axis; and a shear zone extending longitudinally along the central axis for at least a portion of the tubular wall such that the shear zone severs with less force than the coring inner barrel, wherein the shear zone is scored and heat treated to create a portion that has a lower ductility than the coring inner barrel.

2. The system of claim 1, wherein the ductility of the shear zone is determined according to an elongation ratio given by the formula:

$$\left(\frac{\varepsilon_{inner\ barrel}}{\varepsilon_{shear}}\right) = \varepsilon_{ratio}$$

where:

$\varepsilon_{inner\ barrel}$=elongation measurement of the coring inner barrel;

$\varepsilon_{shear}$=elongation measurement of the shear zone;

$\varepsilon_{ratio}$=the elongation ratio; and where the elongation ratio is greater than or equal to one.

3. The system of claim 1, wherein the ductility of the shear zone has a fracture strain of less than 5%.

4. The system of claim 1, wherein the shear zone is constructed of a different material than the coring inner barrel.

5. The system of claim 1, wherein the shear zone extends a longitudinal length along the connector sub such that the shear zone is adapted to be cut with a pipe cutter.

6. An inner barrel system comprising:

a coring inner barrel including a tubular wall defining a central axis and having a shear zone extending longitudinally along at least a portion of the tubular wall such that the shear zone severs with less force than the adjacent portions of the tubular wall, wherein the shear zone is scored and heat treated to create a portion that has a lower ductility than the coring inner barrel.

7. The system of claim 6, wherein the ductility of the shear zone is determined according to an elongation ratio given by the formula:

$$\left(\frac{\varepsilon_{inner\ barrel}}{\varepsilon_{shear}}\right) = \varepsilon_{ratio}$$

where:

$\varepsilon_{inner\ barrel}$=elongation measurement of the coring inner barrel;

$\varepsilon_{shear}$=elongation measurement of the shear zone;

$\varepsilon_{ratio}$=the elongation ratio; and where the elongation ratio is greater than or equal to one.

8. The system of claim 6, wherein the ductility of the shear zone has a fracture strain of less than 5%.

9. The system of claim 6, wherein the shear zone is constructed of a different material than the adjacent portions of the tubular wall.

10. The system of claim 6, wherein the shear zone extends a longitudinal length along the tubular wall such that the shear zone is adapted to be cut with a pipe cutter.

11. A method comprising:

coupling a connector sub with a coring inner barrel, the connector sub including:

a tubular wall defining a central axis; and a shear zone extending longitudinally along the central axis for at least a portion of the tubular wall such that the shear zone severs with less force than the coring inner barrel, wherein the shear zone is scored and heat treated to create a portion that has a lower ductility than the coring inner barrel;

using the coring inner barrel in a coring operation; and using a cutting tool to sever the connector sub at the shear zone.

12. The method of claim 11, wherein the ductility of the shear zone is determined according to an elongation ratio given by the formula:

$$\left(\frac{\varepsilon_{inner\ barrel}}{\varepsilon_{shear}}\right) = \varepsilon_{ratio}$$

where:

$\varepsilon_{inner\ barrel}$=elongation measurement of the coring inner barrel;

$\varepsilon_{shear}$=elongation measurement of the shear zone;

$\varepsilon_{ratio}$=the elongation ratio; and where the elongation ratio is greater than or equal to one.

13. The method of claim 11, wherein the ductility of the shear zone has a fracture strain of less than 5%.

14. The method of claim 11, wherein the shear zone is constructed of a different material than the coring inner barrel.

15. The method of claim 11, wherein the shear zone extends a longitudinal length along the connector sub such that the shear zone is adapted to be cut with a pipe cutter.

16. A method comprising:

coupling a first coring inner barrel with a second coring inner barrel, the first coring inner barrel including:

a tubular wall defining a central axis; and a shear zone extending longitudinally along at least a portion of the tubular wall such that the shear zone severs with less force than adjacent portions of the tubular wall, wherein the shear zone is scored and heat treated to create a portion that has a lower ductility than the coring inner barrel;

using the first coring inner barrel and the second coring inner barrel in a coring operation; and using a cutting tool to sever the first coring inner barrel at the shear zone.

17. The method of claim 16, wherein the ductility of the shear zone is determined according to an elongation ratio given by the formula:

$$\left(\frac{\varepsilon_{inner\ barrel}}{\varepsilon_{shear}}\right) = \varepsilon_{ratio}$$

where:

$\varepsilon_{inner\ barrel}$=elongation measurement of the coring inner barrel;

$\varepsilon_{shear}$=elongation measurement of the shear zone;

$\varepsilon_{ratio}$=the elongation ratio; and where the elongation ratio is greater than or equal to one.

18. The method of claim 16, wherein the ductility of the shear zone has a fracture strain of less than 5%.

19. The method of claim 16, wherein the shear zone is constructed of a different material than the adjacent portions of the tubular wall.

20. The method of claim 16, wherein the shear zone extends a longitudinal length along the tubular wall such that the shear zone is adapted to be cut with a pipe cutter.

* * * * *